US006860438B1

(12) United States Patent
Huang

(10) Patent No.: US 6,860,438 B1
(45) Date of Patent: Mar. 1, 2005

(54) SPRAY GUN

(76) Inventor: Tiao-Hsiang Huang, No. 190, Chung Cheng St., Shin Chuang City, Taipei Hsien (TW)

( * ) Notice: Subject to any disclaimer, the term of this patent is extended or adjusted under 35 U.S.C. 154(b) by 0 days.

(21) Appl. No.: 10/817,933

(22) Filed: Apr. 6, 2004

(51) Int. Cl.[7] ..... B05B 1/16
(52) U.S. Cl. ..... 239/394; 239/526
(58) Field of Search ..... 239/390, 394, 239/526

(56) References Cited

U.S. PATENT DOCUMENTS 4,103,830 A * 8/1978 Roth ..... 239/587.4
5,630,548 A * 5/1997 Chih ..... 239/394
6,719,219 B1 * 4/2004 Wang ..... 239/526

* cited by examiner

*Primary Examiner*—David A. Scherbel
*Assistant Examiner*—Thach H. Bui
(74) *Attorney, Agent, or Firm*—Rosenberg, Klein & Lee

(57) ABSTRACT

A spray gun includes a gun body, a ferrule and a head. The ferrule is screwed to the gun body. A plurality of through holes are disposed on the ferrule with each inserted with a bead. A ring is provided on the outer circumference of the ferrule. A flange is provided on the inner circumference of the ring in relation to the through holes. The flange holds against and keeps the beads protruding from their respective through holds. The beads are locked in respective recesses on a locking end at the rear of the head to allow fast removal of the head from the gun body and revolving of the head.

1 Claim, 6 Drawing Sheets

SPRAY GUN

BACKGROUND OF THE INVENTION (a) Field of the Invention

The present invention is related to a spray gun with a revolving and interchangeable head, and more particularly to one allows rapid removal and swivel of the head by inserting a locking end of the head into a ferrule on the gun body and held against by beads in a ring of the ferrule.

(b) Description of the Prior Art

A conventional spray gun generally available in the market has a gun body and a head interlocked to each other. Both of the gun body and the head are prevented from being separated from each other as desired. The coverage of the paint sprayed out of a nozzle indicates an oval shape. In case of different surfaces of the object to be painted, the spray becomes awkward since the user has to hold the spray gun to incline to a certain angle by compromising the profile of the object.

SUMMARY OF THE INVENTION

The primary purpose of the present invention is to provide a spray gun with a revolving and exchangeable head to allow easy assembly. To achieve the purpose, a plurality of through holes are provided on a ferrule with each through hole inserted with a bead and a ring on the outer circumference of the ferrule. A spring is inserted between the ring and the ferrule. A flange is disposed on the inner circumference of the ring in relation to the through holes of the ferrule. The flange holds against the beads to constantly protrude from the through holes. A locking end provided on the head has a plurality of recesses provided on the outer circumference to receive their corresponding beads.

DETAILED DESCRIPTION OF THE PREFERRED EMBODIMENTS

Figure 1:
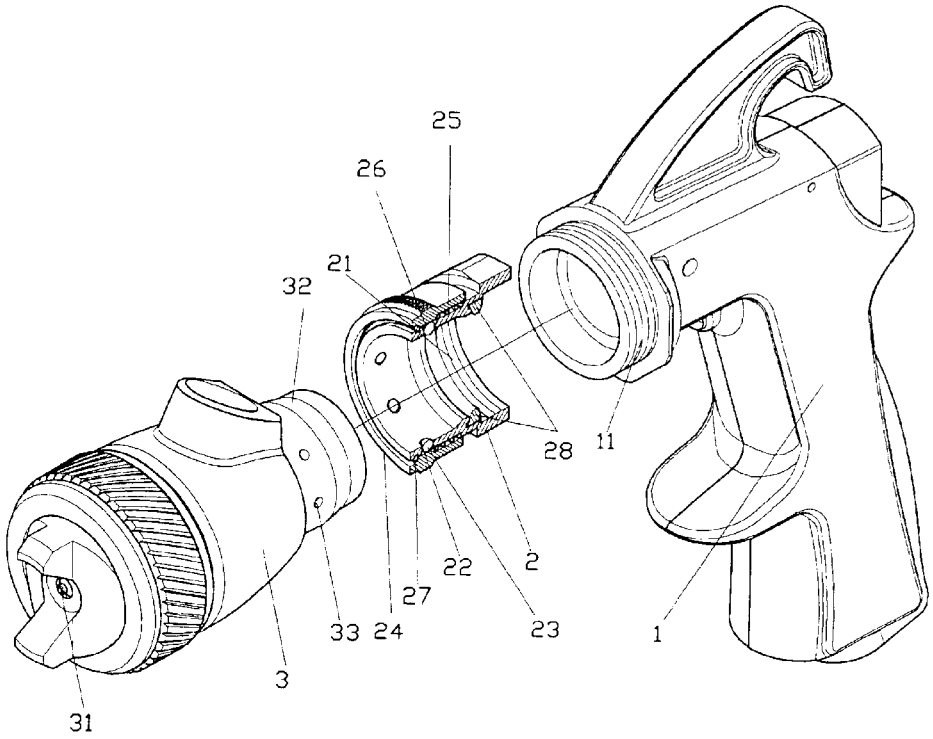
FIG. 1 is an exploded view of the present invention.

Referring to FIG. 1, the present invention is essentially comprised of a gun body (1), a ferrule (2) and a head (3).

The gun body (1) is provided with a threaded portion (11) at its front end.

The ferrule (2) screwed to the threaded portion (11) of the gun body (1) is provided with a threaded portion (21) on the inner circumference at the rear of the ferrule (2) to be inserted with a washer (28). A plurality of through holes (22) are provided on the front edge with each inserted with a bead (23). A ring (24) is provided on the outer circumference of the ferrule (2) and a spring (25) is inserted between the ring (24) and the ferrule (2). A flange (26) is provided on the inner circumference of the ring (24) in relation to the through holes (22) and the flange (26) holds against those beads (23) and keeps them constantly to protrude out of through holes (22). A C-shaped clamp (27) is locked to the front end of the ferrule (2) to prevent the ring (24) from being disengaged from the ferrule (2).

The head (3) is locked to the ferrule (2). A nozzle (31) is disposed at the front end of the head (3) and a locking end (32) is provided at the rear of the head (3). A plurality of recesses (33) are provided on the outer circumference of the locking end (32).

Figure 2:
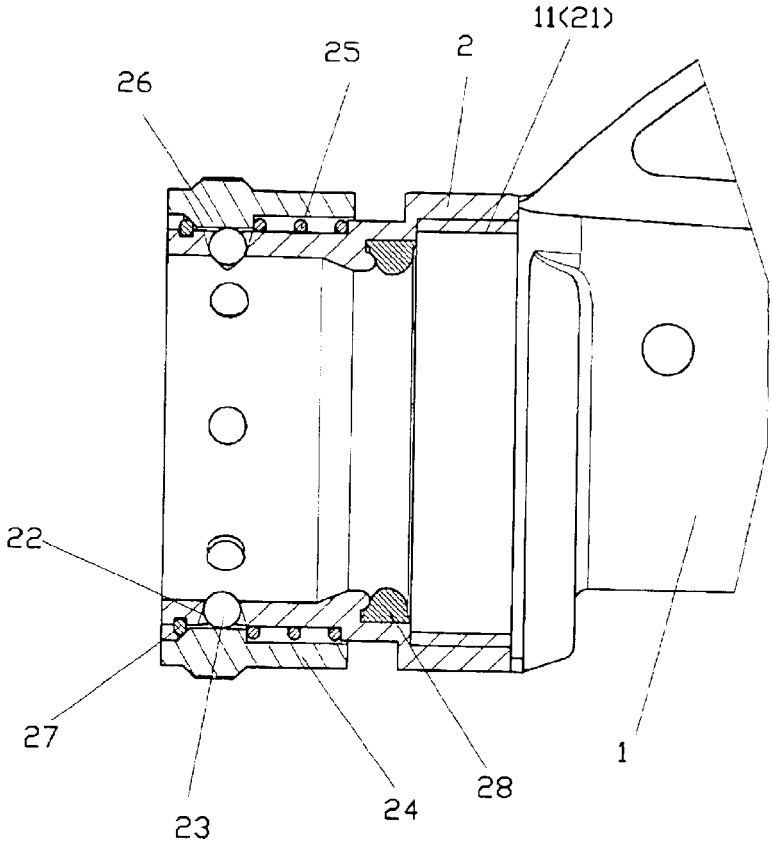
FIG. 2 is a sectional view of the present invention as assembled.
Figure 3:
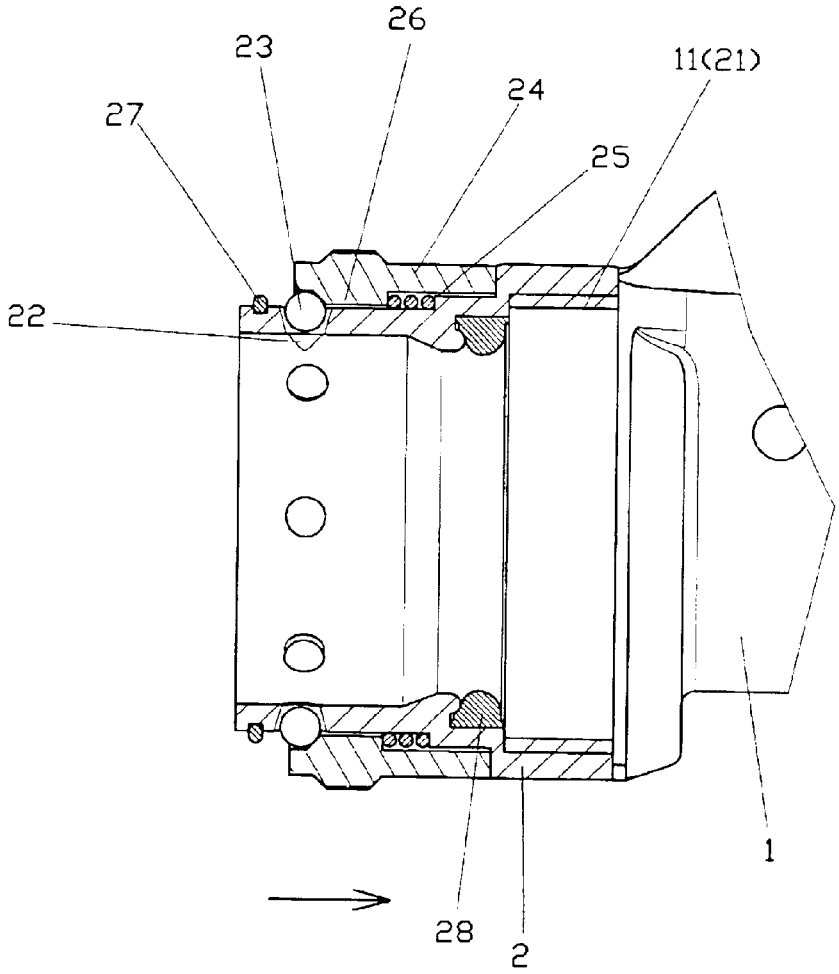
FIG. 3 is a schematic view showing the push of a ring of the present invention.
Figure 4:
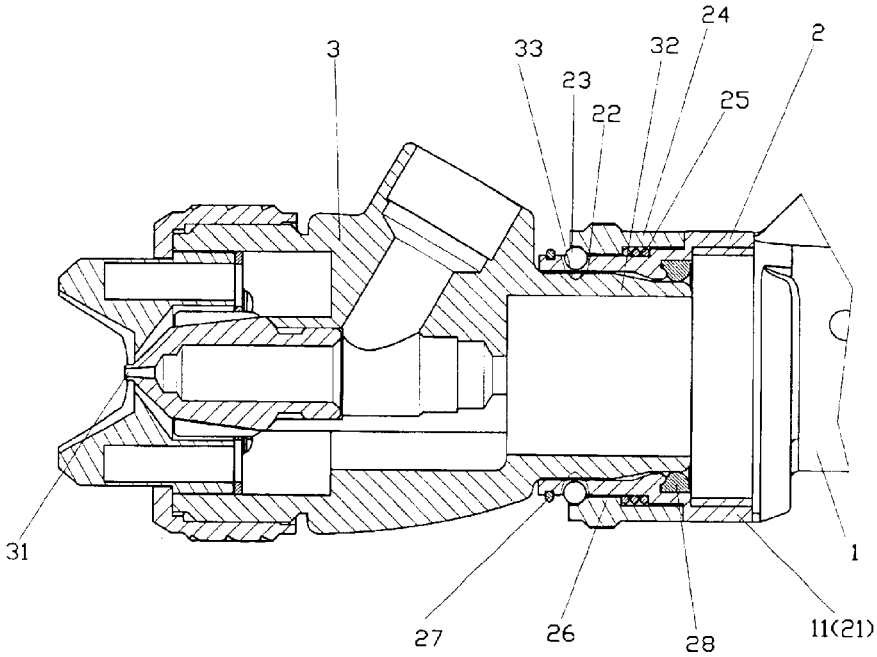
FIG. 4 is a schematic view showing a locking end is engaged into a ferrule of the present invention.
Figure 5:
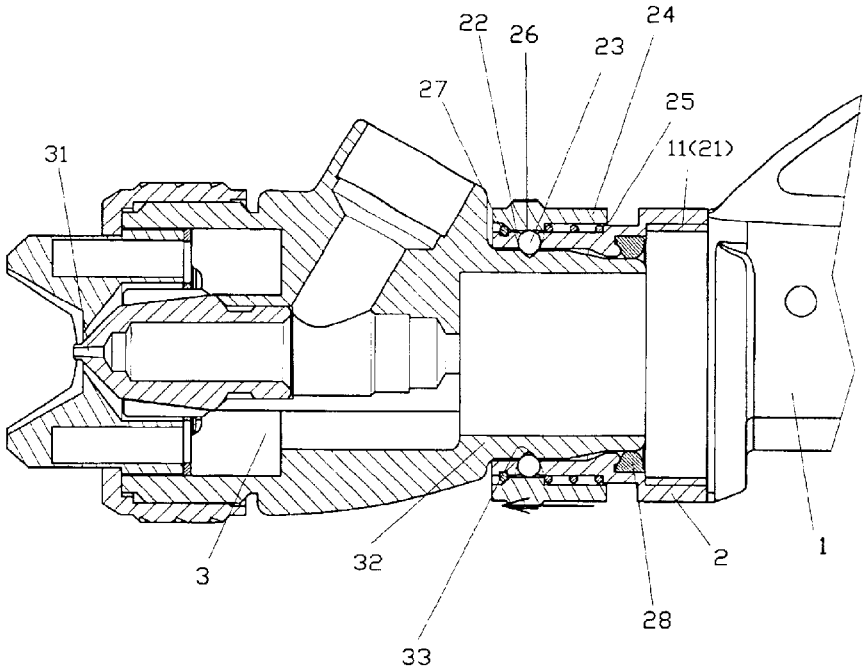
FIG. 5 is a schematic view showing the present invention completed with the assembly.

As illustrated in FIG. 2, the threaded portion (21) of the ferrule (2) is engaged with the threaded portion (11) of the gun body (1) with the washer (28) to hold against and seal where both threaded portions (21) and (11) are engaged. The ring (24) on the ferrule (2) is pushed backward as illustrated in FIG. 3 to compress the spring (25) for the flange (26) of the ring (24) no longer holding against the beads (23). Meanwhile, the locking end (32) of the head (3) is locked in the ferrule (2) as illustrated in FIG. 4 to hold against the beads (23) to retreat into the through holes (22). Accordingly the locking end (32) of the head (3) is easily inserted into the ferrule (2) while having the recesses (33) on the locking end (32) to be aligned at their corresponding beads (23). The ring (24) is released and returned to its original position by taking advantage of the return force from the spring (25), and the flange (26) of the ring (24) once again holds against the beads (23) for each bead (23) to protrude from its respective through hole (22) as illustrated in FIG. 5. With each bead (23) locked in its respective recess (33) on the locking end (32), the head (3) is secured to the ferrule (2) to achieve a fast incorporation between the head (3) and the gun body (1) for the spray gun to spray paint on the surface of a work object.

Figure 6:
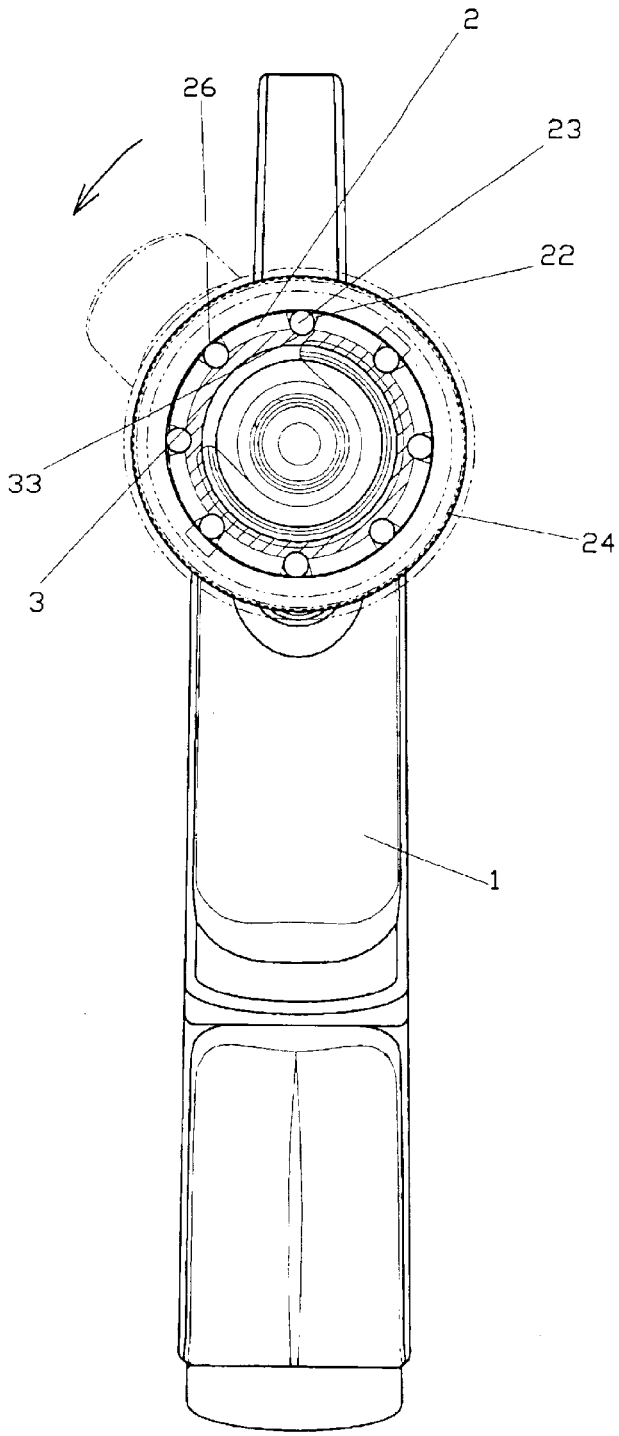
FIG. 6 is a schematic view showing a revolving spray gun head of the present invention.

Now referring to FIG. 6, when working on any other surface of the work object and different angle of the head (3) is required, the ring (24) on the ferrule (2) is pushed backward to compress the spring (25) for the flange (26) of the ring (24) no longer holding against the beads (23) so to revolve the head (3). As the head (3) revolves, the locking end (32) of the head (3) holds against the beads (23) for them to retreat into their respective through holes (22) for allowing easy revolving of the head (3). Once the head (3) is revolved to the angle as desired, the ring (24) is released and returned to its original position by taking advantage of the return force from the spring (25) for the flange (26) of the ring (24) to once again hold against and push the beads (23) to protrude from their respective through holes (22), thus to be locked in the recesses (33) on the locking end (32) and to secure the head (3) in the ferrule (2).

When the head (3) with other type of nozzle (31) is required, the existing head (3) is removed from the ferrule (2) by pushing the ring (24) on the ferrule (2) for the flange (26) of ring (24) no longer holding against the beads (23), then the locking end (32) of the head (3) can be forthwith removed from the ferrule (2) for the replacement with another head (3).

The present invention provides the following advantages:

1. The angel of the head can be easily adjusted by revolving the head of the spray gun depending on the surface of the work object.
2. The head can be easily separated from the body of the spray gun to allow easy interchanging among different types of head.

I claim:

1. A spray gun comprising a gun body, a ferrule, and a head; the ferrule being engaged to the gun body, the head being locked to the ferrule, and a nozzle being disposed to the head, and characterized by:

a plurality of through holes being provided on the ferrule; each through hole being inserted with a bead; a ring being provided on an outer circumference of the ferrule; a spring being inserted between the ring and the ferrule; a flange being disposed on an inner circumference of the ring in relation to the through holes; the flange holding against and keeping the beads constantly protruding out of their through holes; a locking end being provided at a rear end of the head; and a plurality of recesses to receive the beads being provided on an outer circumference of the locking end.

* * * * *